US006079430A

United States Patent [19]

Yamamoto

[11] Patent Number: 6,079,430

[45] Date of Patent: Jun. 27, 2000

[54] AUTOMATIC FOLD-UP UMBRELLA

[76] Inventor: Yasuyuki Yamamoto, 20-9, Higashimo 1-chome, Urayasu City, Chiba Prefecture, Japan

[21] Appl. No.: 09/161,544

[22] Filed: Sep. 28, 1998

[30] Foreign Application Priority Data

Aug. 31, 1998 [JP] Japan ..... 10-262317

[51] Int. Cl.[7] ..... A45B 3/00

[52] U.S. Cl. ..... 135/16; 135/15.1; 135/33.2; 135/33.4

[58] Field of Search ..... 135/15.1, 16, 33.2, 135/33.4

[56] References Cited

U.S. PATENT DOCUMENTS

| | | | |
|---|---|---|---|
| 4,794,939 | 1/1989 | Okuda | 135/33.2 |
| 5,150,728 | 9/1992 | Stark | 135/16 |

FOREIGN PATENT DOCUMENTS

| | | |
|---|---|---|
| 50-41754 | 4/1975 | Japan . |
| 54-113664 | 8/1979 | Japan . |
| 3-9613 | 1/1981 | Japan . |
| 57-113027 | 7/1982 | Japan . |
| 5-7118 | 2/1993 | Japan . |
| 6-61118 | 8/1994 | Japan . |
| 3029880 | 7/1996 | Japan . |

*Primary Examiner*—Beth A. Stephan
*Attorney, Agent, or Firm*—Wederoth, Lind & Ponack, L.L.P.

[57] ABSTRACT

An automatic fold-up umbrella for easier closing has a frame having an umbrella shaft and a plurality of radial ribs. A canopy supported on the radial ribs. Elastic bodies are sewn up into every other half peripheral edge portion of the canopy to be located between the rib and a folding line of a partial canopy along an intermediate portion between the neighboring ribs. Alternatively a shape-metal alloy is sewn into one of the partial canopies so that when the umbrella is closed, the canopy can be automatically, spirally or volutely rolled in to form a curved or spiral state from the folding lines.

8 Claims, 8 Drawing Sheets

AUTOMATIC FOLD-UP UMBRELLA

BACKGROUND OF THE INVENTION

1. Field of the Invention

This invention relates to an automatic fold-up umbrella for easier closing, and more particularly to an improved automatic fold-up umbrella which can be easily and automatically closed without touching a collapsed fluttering canopy.

2. Description of the Prior Art

As shown in FIG. 1, when a user tries to close an umbrella that got wet in the rain, a canopy on a folding frame of canopy ribs, each canopy rib being pivotally attached at its pivot end to a rib runner notch which is slidably engaged with an umbrella shaft of the umbrella, is closed as narrow as possible.

The edge portions of the folded canopy, however, stretch around the umbrella shaft of the umbrella as shown in FIG. 2. When the user brings the wet umbrella into a bus or train jammed with people, it is most likely to trouble neighboring persons by moistening their dress with the wet canopy.

It has been conventional that the wet canopy of the umbrella is wrapped around the umbrella shaft by a strap having a length of about 15 cm. provided at an intermediate portion of the canopy in order to minimize the surface area of the wet canopy.

It is troublesome for the user to bundle the wet canopy with the strap, and it always moistens the hands of the user so that there are many users who bring wet umbrellas without bundling the wet canopies.

The latest fashion is required for an umbrella, and there have been provided a number of new designs for canopies of conventional umbrellas. But few designs have been made in the shape of the umbrella itself.

SUMMARY AND OBJECTS OF THE INVENTION

A principal object of this invention is to provide an automatic fold-up umbrella whereby a dry or wet canopy on a rib assembly of the umbrella can be closed around an umbrella shaft automatically and easily without using the hands.

Another object of this invention is to provide an automatic fold-up umbrella to facilitate closing a wet canopy of the umbrella around an umbrella shaft automatically and easily without troubling a neighboring person with a wider wet canopy.

Another object of this invention is to provide an automatic fold-up umbrella which can be made into a compact carriable unit.

Another object of this invention is to provide an automatic fold-up umbrella having an elegant fashion for the folded umbrella itself.

A further object of this invention is to provide an automatic fold-up umbrella which can be easily made.

Still another object of this invention is to provide an automatic fold-up umbrella which can be handled easily.

DETAILED DESCRIPTION OF THE PREFERRED EMBODIMENT

Figure 1:
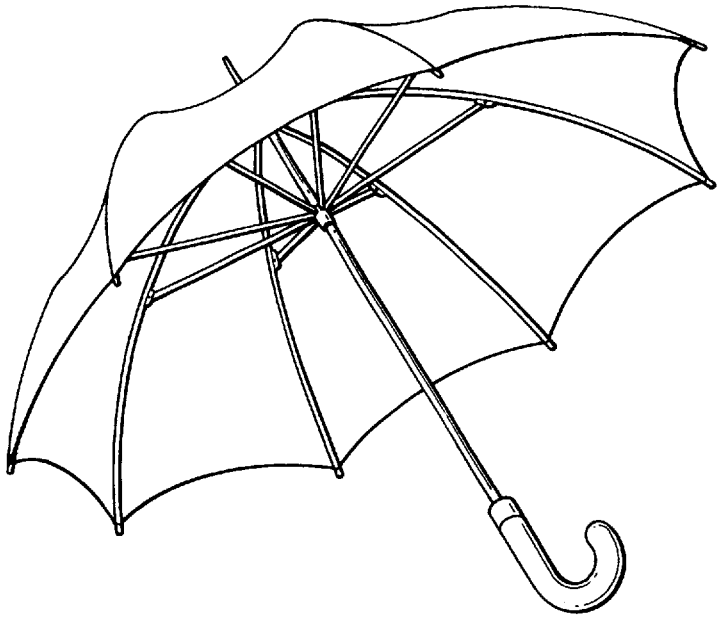
FIG. 1 (PRIOR ART)
FIG. 1 is a perspective view of an opened conventional umbrella.
Figure 2:
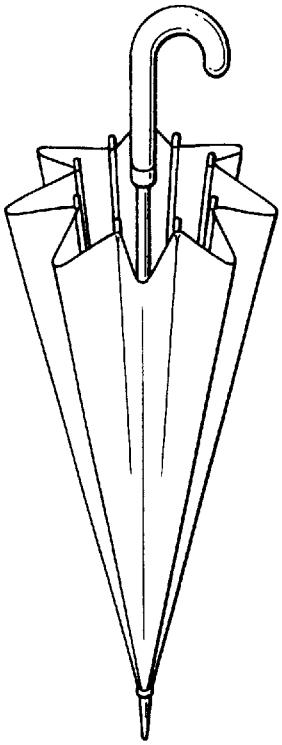
FIG. 2 (PRIOR ART)
FIG. 2 is a perspective view of the closed umbrella shown in FIG. 1.
Figure 3:
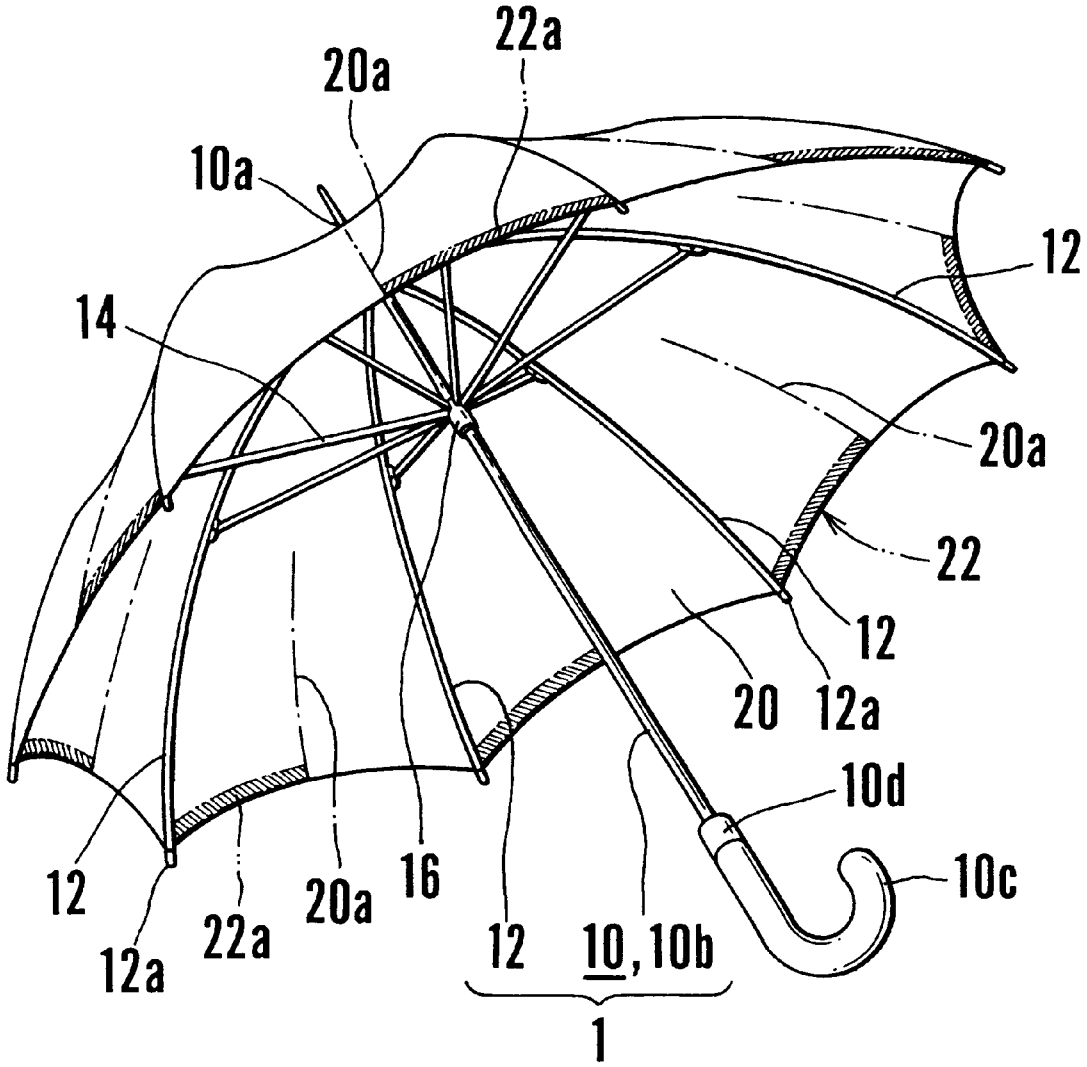
FIG. 3 is a perspective view of an opened umbrella in accordance with this invention.
Figure 4:
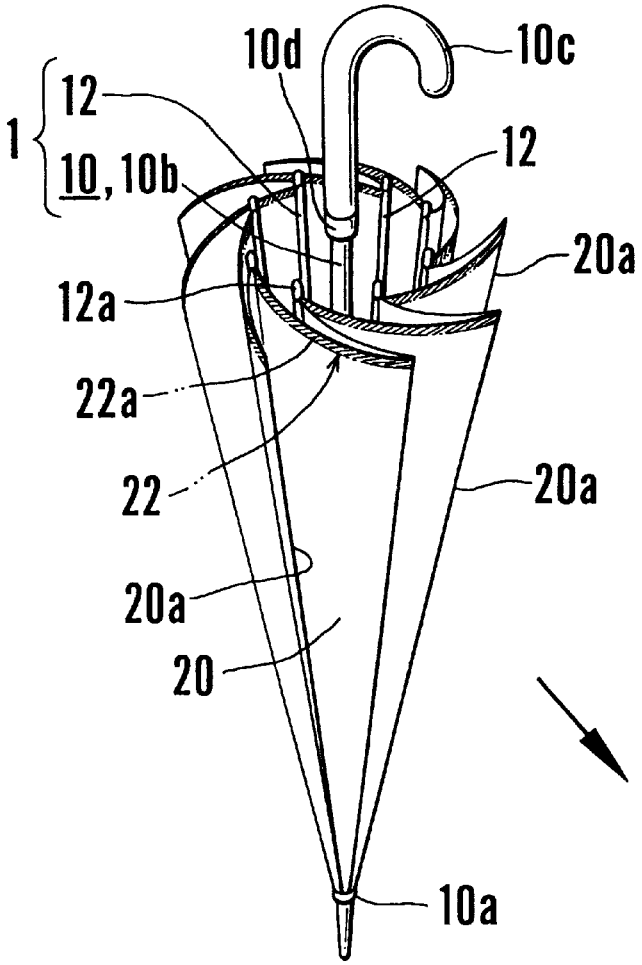
FIG. 4 is a perspective view of the umbrella shown in FIG. 3, which is being closed.
Figure 5:
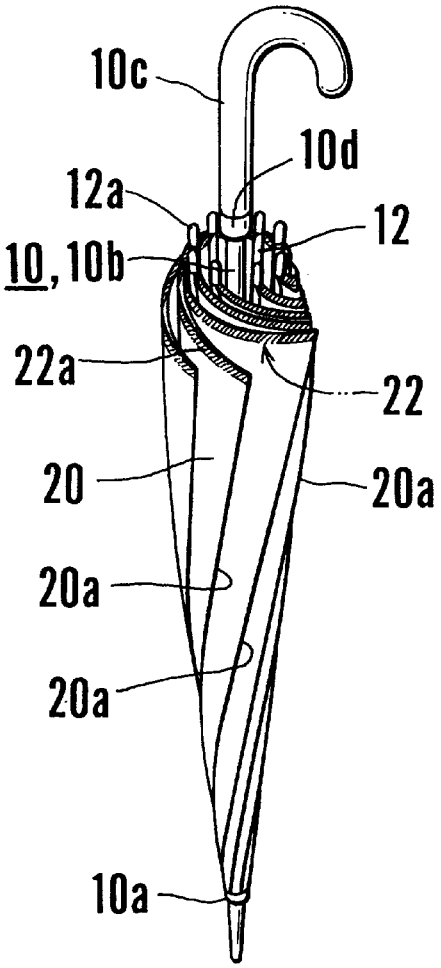
FIG. 5 is a perspective view of the umbrella which is closed spirally.
Figure 6:
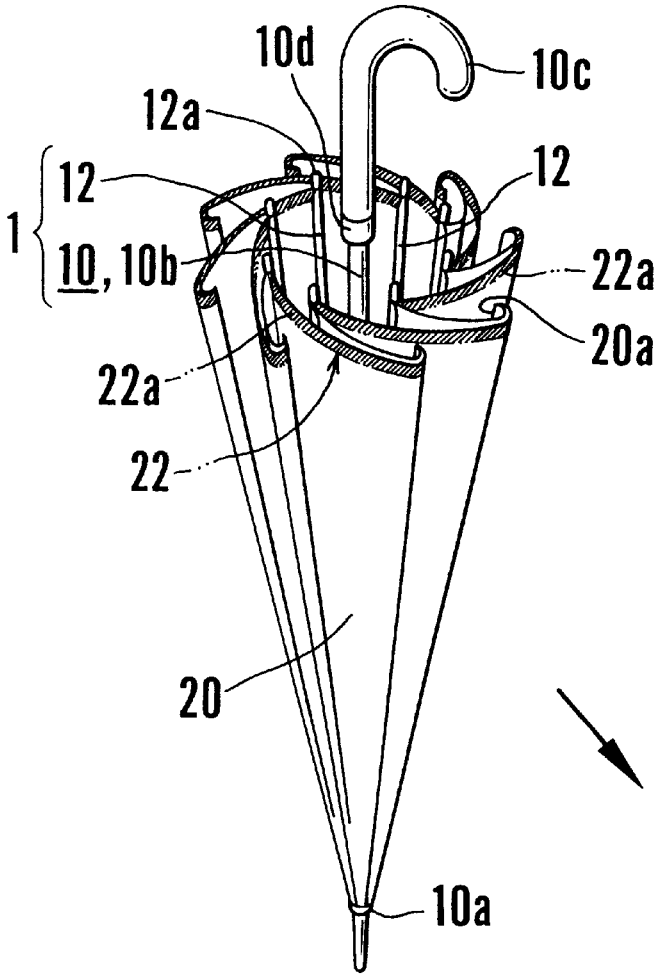
FIG. 6 is a perspective view of the umbrella which is be closed volutely.
Figure 7:
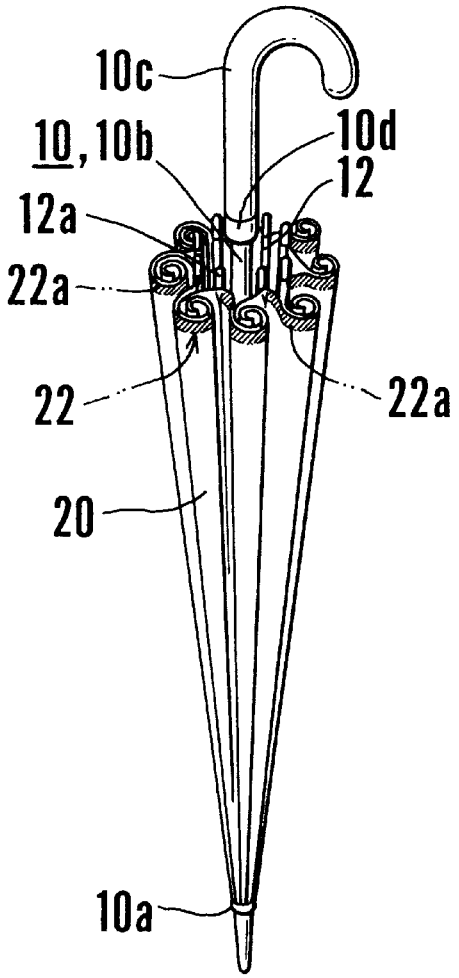
FIG. 7 is a perspective view of the umbrella, partial canopies of which are volutely closed.
Figure 8:
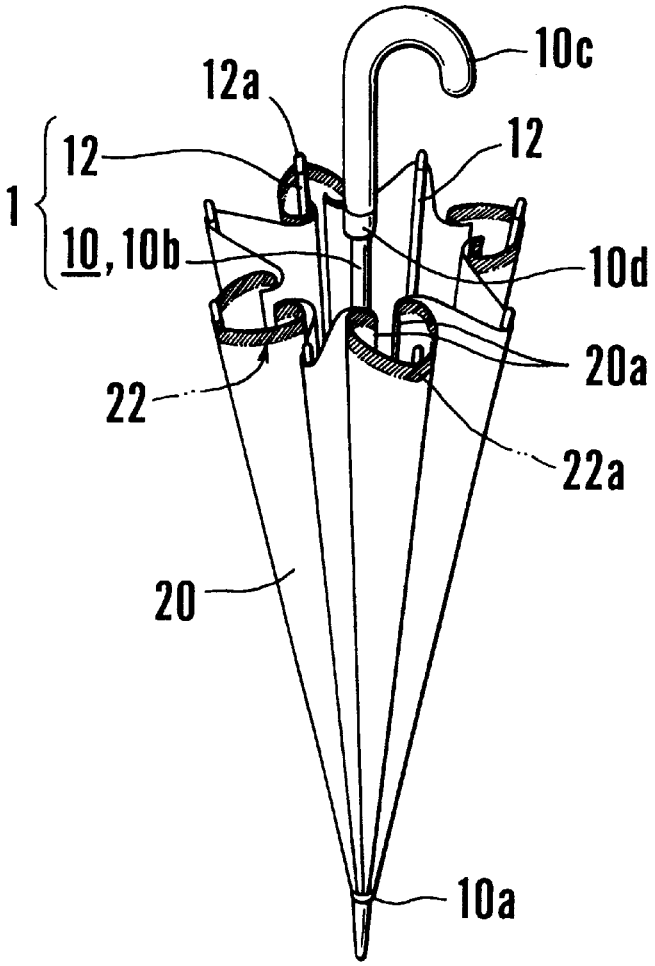
FIG. 8 is a perspective view of another embodiment of this invention, partial canopies of which are being closed volutely.
Figure 9:
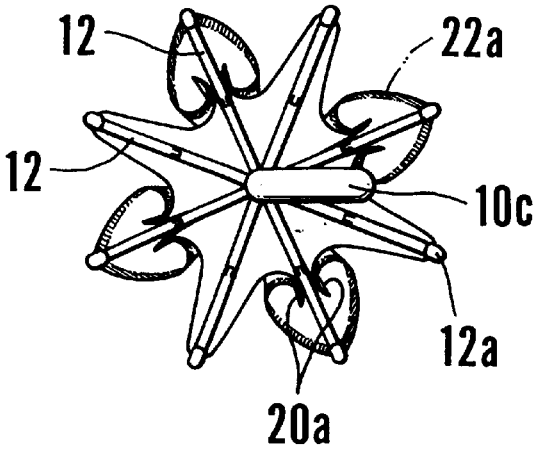
FIG. 9 is a view of the umbrella shown in FIG. 8.
Figure 10:
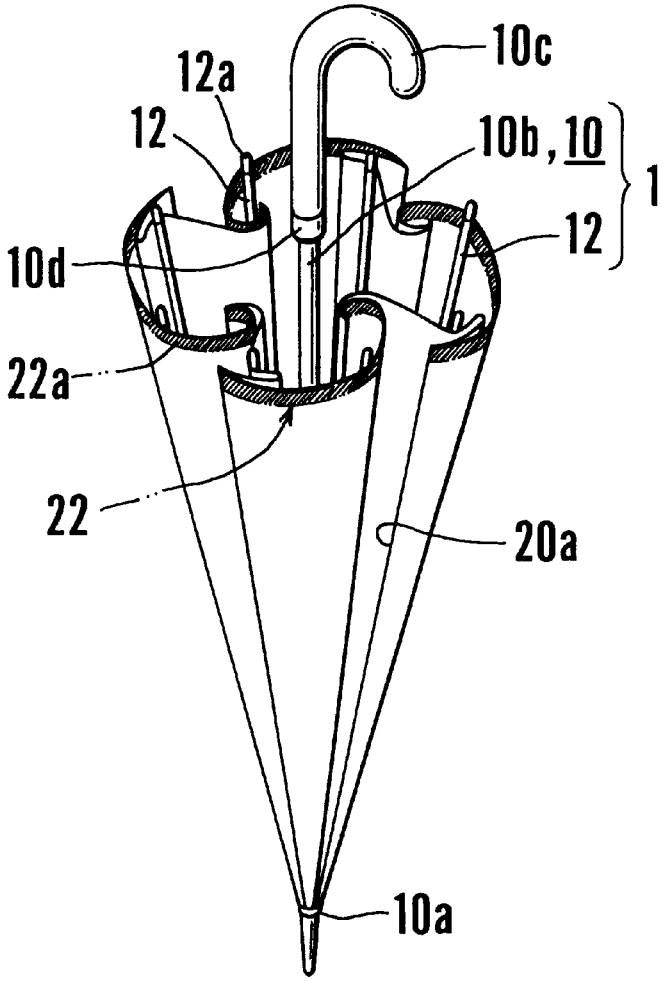
FIG. 10 is a perspective view of another embodiment having a plurality of elastic bodies which are integrally provided along a peripheral edge of a canopy of this invention.
Figure 11:
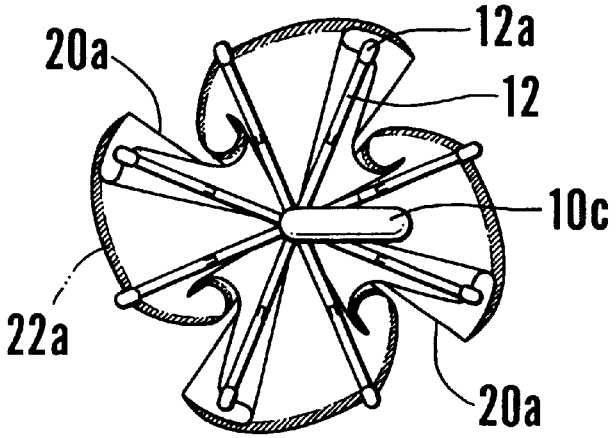
FIG. 11 s a plan view of the umbrella shown in FIG. 10, in which a combination of curved and spiral canopy edges are shown.

Referring to the accompanying drawings in which like numerals designate the like parts throughout the several views thereof, there is shown in FIGS. 3–5, a first embodiment of an umbrella according to the present invention.

The umbrella is generally comprised of a frame unit 1 having an umbrella shaft 10 and a plurality of radial ribs 12, an open control spring (not shown) and a collapse spring (not shown).

The an umbrella shaft 10 includes a top notch (not shown) provided near a top end portion 10*a*, an intermediate tube portion 10*b* and a grip 10*c* secured to a lower end portion of the intermediate tube portion 10*b*.

A runner notch 16 is slidably mounted around the intermediate tube portion 10*b*. A plurality of the ribs 12 are pivotally secured to the frame unit 1, a top end portion of each rib being pivotally secured to the top notch. A plurality of stretcher ribs 14 are pivotally secured between the runner notch 16 and at the intermediate portions of the ribs 12, and a ring 10*d* for holding the top portions 12*a* of the ribs 12 is slidably provided at a top portion of the grip 10*c*. A light circular canopy 20 of cotton, silk, vinyl sheet or other material is supported on the ribs 12.

Through the vertical movement of the runner notch 16, the canopy 20 and the ribs 12 are opened or closed by the open control spring and the collapse spring.

In FIG. 3, a plurality of bodies 22, such as tension springs 22*a* are sewn up into every other half peripheral edge portion of the canopy 20 between the neighboring ribs 12 so that one or both of the partial canopies 20 are rolled in into a curved (as shown in FIG. 4) or spiral shape (as shown in FIG. 5) from the folding lines 20*a* of the partial canopies 20, thus forming peaks and troughs of the folded canopy 20.

When the runner notch 16 is moved up, the umbrella 11*a* is opened by the open control spring to extend the tension springs 22*a* as shown in FIG. 3.

On the other hand, when the runner notch 16 is lowered, the opened canopy 20 is closed by the collapse spring to form the peaks and troughs of the folded canopy 20 as shown in FIGS. 4 and 5.

It can be understood that the direction for rolling a partial canopy 20 in between the two neighboring ribs 12, either the clockwise or counterclockwise direction, can be adopted as desired. The of the peaks and troughs of the canopy 20 can be combined as desired as shown in FIGS. 8–11.

As shown in FIGS. 8–11, it is possible to adopt the direction of rolling in the collapsed canopy 20 and also to combine the curved state with the spiral state.

Figure 12:
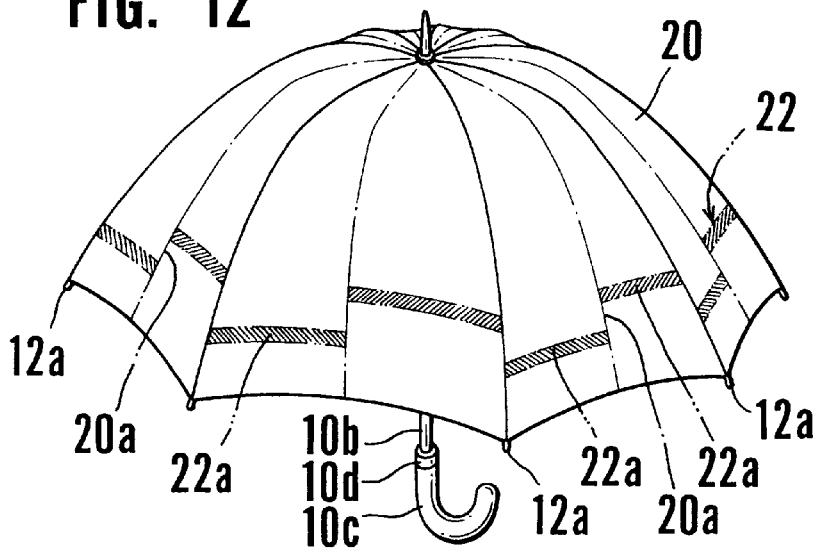
FIG. 12 is a perspective view of an opened umbrella having a pair of elastic bodies integrally provided at a middle portion of a partial canopy between two ribs.

In FIG. 12, a pair of metal or plastic tension springs or weak spiral springs 22*a* are sewn up into a partial canopy 20 to locate at each half portion, the tension springs 22*a* standing on different mate.

When the strength of stability of the tension or spiral spring 22*a* is too strong, it becomes difficult to open the umbrella.

On the other hand, when the strength of stability of the tension or spiral spring 22*a* is too weak, the collapsed fluttering canopy 20 cannot be sufficiently rolled in so that a suitable strength of stability of the tension or spiral spring 22*a* must be required.

Figure 13:
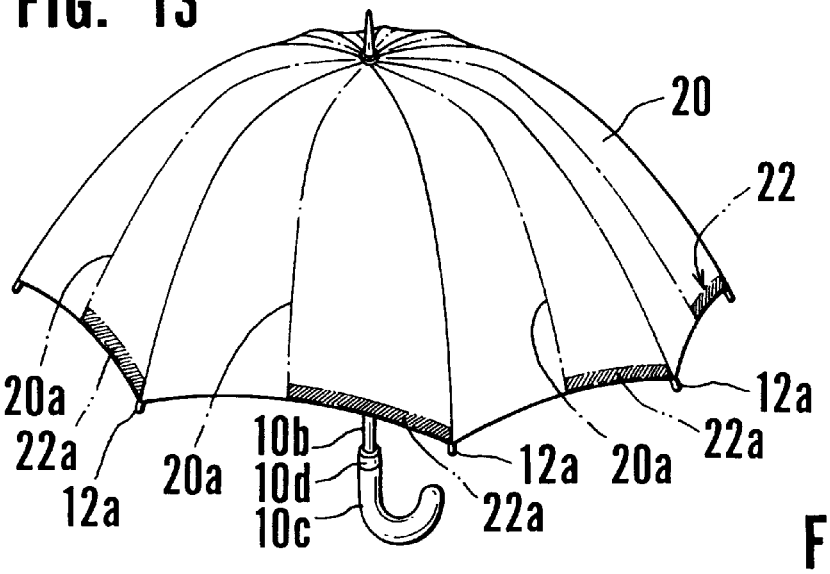
FIG. 13 is a perspective view of an opened umbrella having a single elastic body integrally provided at a peripheral edge of a partial canopy between two ribs.

In FIG. 13, another embodiment of the umbrella is shown, in which one or two tension or spiral spring 22*a* are sewn up in the peripheral edge portion of the partial canopy 20 to be located the partial canopy 20 separated by the middle folding line 20*a*.

Figure 14:
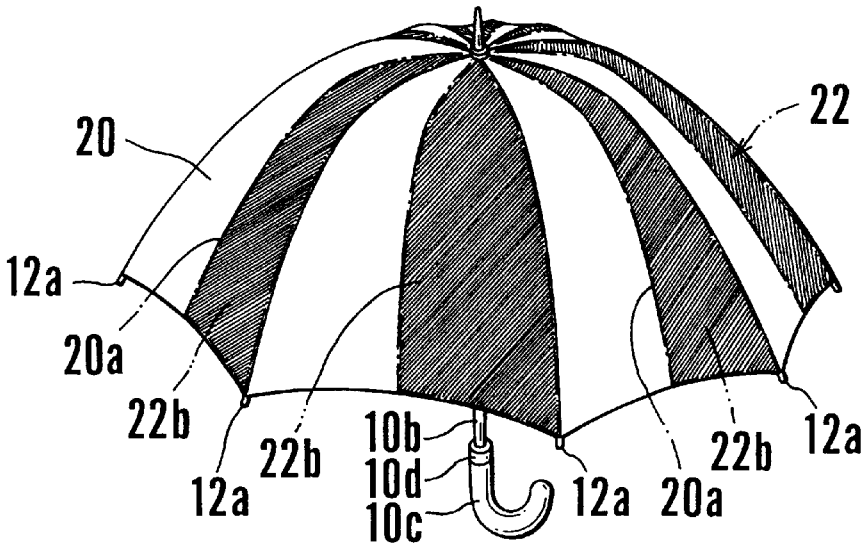
FIG. 14 is a perspective view of an opened umbrella having a shape-memory alloy integrally provided at a peripheral edge of a partial canopy between two ribs.
Figure 15:
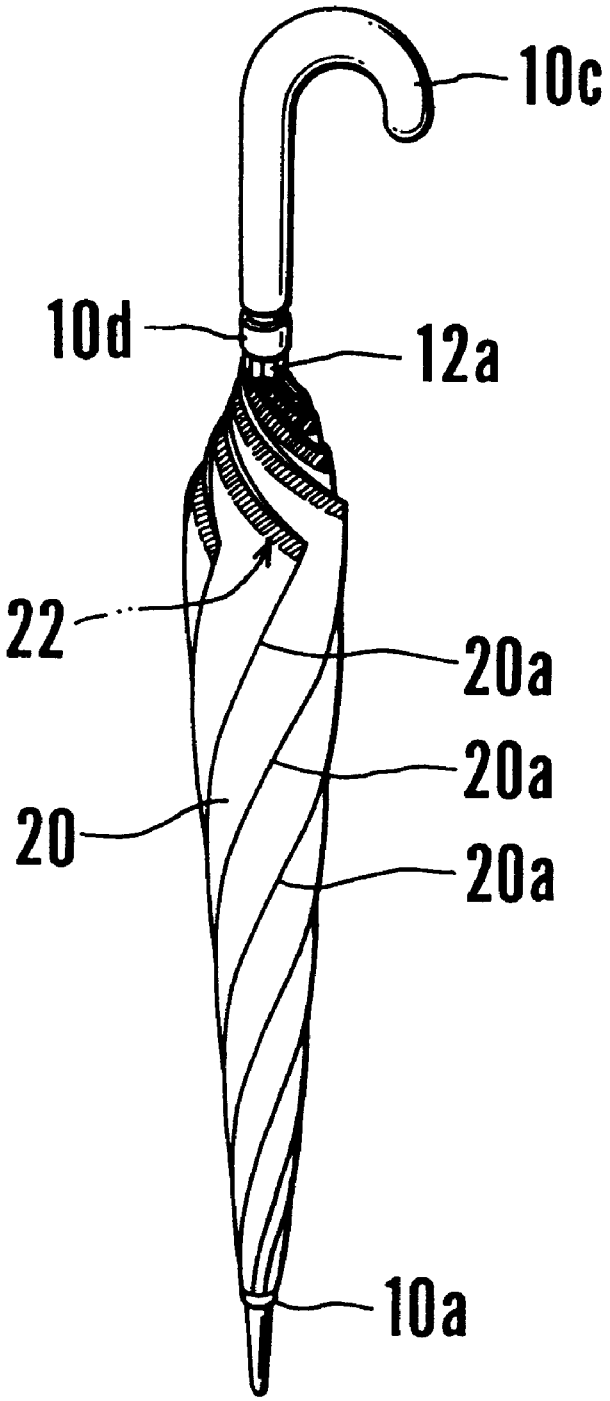
FIG. 15 a perspective view of the closed umbrella shown in FIG. 14.

In FIG. 14, still another embodiment of the umbrella is shown, in which a shape-metal alloy 22*b* is sewn into one of the partial canopies 22 so that when the umbrella is closed, the canopy 22 can be automatically and spirally wrapped, which is shown in FIG. 15 with all of the top portions 12*a* of the ribs 12 are held into the ring 10*d*.

It is preferable to provide the shape-metal alloy 22*b* into one or both partial canopies 22, but it must be remembered that when the shape-metal alloy 22*b* has a strong strength of stability, it becomes difficult to roll in the collapsed canopy 20.

On the other hand, when the strength of stability of the shape-metal alloy 22*b* is too weak, the collapsed fluttering canopy 20 cannot be sufficiently rolled in so that a suitable strength of stability of the shape-metal alloy 22*b* must be required.

It is also possible to jointly use the tension spring 22a and the shape-metal alloy 22*b*.

For example, the shape-metal alloy 22*b* is provided at one of the partial canopy 20, the tension spring 22*a* is provided at another partial canopy 20, and their location can be changed alternatively.

It may be preferable to provide the tension spring 22*a* on the shape-metal alloy 22*b* of the canopy 20 in order to increase the strength of stability.

While the forms of the invention described constitute herein presently preferred embodiments many others are possible. It is not intended herein to mention all of the possible equivalent forms or ramifications of the invention.

It is to be understood that the terms used herein are merely descriptive rather than limiting, and that various changes may be made without departing from the spirit or scope of the invention.

What is claimed is:

1. An automatic fold-up umbrella, comprising:

an umbrella shaft having a top end portion, an intermediate tube portion and a grip secured to a lower end of said intermediate tube portion;

a canopy disposed around said umbrella shaft;

a plurality of rib units supporting said canopy on said umbrella shaft, said plurality of rib units comprising radial ribs each having a top end portion and a plurality of stretcher ribs pivotally secured between intermediate portions of said radial ribs and a rib runner slidably supported on said umbrella shaft for up and down movement on said umbrella shaft for opening and closing said canopy; and a ring provided slidably at a top portion of said grip for holding said top end portions of said radial ribs;

wherein said canopy comprises a light circular canopy divided by said radial ribs into partial canopies;

wherein each of said partial canopies has a folding line along an intermediate portion between adjacent ones of said radial ribs; and wherein elastic bodies are sewn up into peripheral edge portions of said canopy so as to each be located between one of said radial ribs and one of said folding lines of said partial canopies, whereby said canopy can be rolled in by rolling said partial canopies into a curved or spiral state from said folding lines thereof.

2. The automatic fold-up umbrella of claim 1, wherein:

said peripheral edge portions comprise two peripheral half edge portions for each of said partial canopies; and said elastic bodies are sewn into every other of said peripheral half edge portions.

3. The automatic fold-up umbrella of claim 1, wherein:

said elastic bodies comprise tension springs.

4. The automatic fold-up umbrella of claim 1, wherein:

said elastic bodies comprise at least one tension or spiral spring sewn up into each of said partial canopies.

5.The automatic fold-up umbrella of claim 1, wherein:

said elastic bodies are postioned in each of said partial canopies such that said partial canopies, between adjacent said radial ribs, can be rolled.

6. The automatic fold-up umbrella of claim 1, wherein:

said elastic bodies are postioned in each of said partial canopies such that said partial canopies between adjacent said radial ribs can be rolled spirally or volutely.

7. An automatic fold-up umbrella, comprising:

an umbrella shaft having a top end portion, an intermediate tube portion and a grip secured to a lower end of said intermediate tube portion;

a canopy disposed around said umbrella shaft;

a plurality of rib units supporting said canopy on said umbrella shaft, said plurality of rib units comprising radial ribs each having a top end portion and a plurality of stretcher ribs pivotally secured between intermediate portions of said radial ribs and a rib runner slidably supported on said umbrella shaft for up and down movement on said umbrella shaft for opening and closing said canopy; and a ring provided slidably at a top portion of said grip for holding said top end portions of said radial ribs;

wherein said canopy comprises a light circular canopy divided by said radial ribs into partial canopies;

wherein each of said partial canopies has a folding line along an intermediate portion between adjacent ones of said radial ribs;

wherein elastic bodies are sewn up into said canopy so as to each be located between one of said radial ribs and one of said folding lines of said partial canopies, whereby said canopy can be rolled in by rolling said partial canopies into a curved or spiral state from said folding lines thereof; and wherein said elastic bodies comprise a pair of metal or plastic tension springs or weak spiral springs sewn up into half portions of each of said partial canopies such that springs of each said pair are offset with respect to each other in each of said partial canopies.

8. An automatic fold-up umbrella, comprising:

an umbrella shaft having a top end portion, an intermediate tube portion and a grip secured to a lower end of said intermediate tube portion;

a canopy disposed around said umbrella shaft;

a plurality of rib units supporting said canopy on said umbrella shaft, said plurality of rib units comprising radial ribs that each have a top end portion and a plurality of stretcher ribs pivotally secured between intermediate portions of said radial ribs and a rib runner slidably supported on said umbrella shaft for up and down movement on said umbrella shaft for opening and closing said canopy; and a ring provided slidably at a top portion of said grip for holding said top end portions of said radial ribs;

wherein said canopy comprises a light circular canopy divided by said radial ribs into partial canopies;

wherein each of said partial canopies has a folding line along an intermediate portion between adjacent ones of said radial ribs; and wherein shape metal alloy is sewn up into said canopy so as to be located between one of said radial ribs and one of said folding lines of one of said partial canopies, whereby said canopy can be automatically spirally or volutely rolled in.

* * * * *